US008578667B2

(12) United States Patent
Yang

(10) Patent No.: US 8,578,667 B2
(45) Date of Patent: Nov. 12, 2013

(54) WATER RESISTANT APPARATUS

(71) Applicant: Xu Yang, Shenzhen (CN)

(72) Inventor: Xu Yang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/677,306

(22) Filed: Nov. 15, 2012

(65) Prior Publication Data

US 2013/0229028 A1 Sep. 5, 2013

(30) Foreign Application Priority Data

Mar. 1, 2012 (CN) ..... 2012 1 0051391

(51) Int. Cl.
*E06B 1/12* (2006.01)

(52) U.S. Cl.
USPC ..... 52/204.1

(58) Field of Classification Search
USPC ..... 52/211, 212, 204.1; 49/469, 472, 474, 49/490.1, 476.1
See application file for complete search history.

(56) References Cited

U.S. PATENT DOCUMENTS

| | | | | | |
|---|---|---|---|---|---|
| 1,231,621 | A * | 7/1917 | Lane | 49/476.1 |
| 1,592,466 | A * | 7/1926 | Morgan | 49/476.1 |
| 2,263,495 | A * | 11/1941 | Hare | 49/476.1 |
| 2,613,406 | A * | 10/1952 | Dean | 49/476.1 |
| 2,922,675 | A * | 1/1960 | Wernig | 52/209 |
| 3,596,980 | A * | 8/1971 | Cadiou | 296/154 |
| 3,912,348 | A * | 10/1975 | Seymour | 312/100 |
| 4,494,790 | A * | 1/1985 | Omura | 296/154 |
| 4,708,898 | A * | 11/1987 | Gommier et al. | 428/36.9 |
| 4,986,039 | A * | 1/1991 | Weisner | 52/72 |
| 5,711,706 | A * | 1/1998 | Griffin et al. | 454/338 |
| 6,874,281 | B2 * | 4/2005 | Fujita et al. | 49/490.1 |
| 7,219,899 | B2 * | 5/2007 | Kesseg | 277/645 |
| 7,430,835 | B1 * | 10/2008 | Larson | 52/204.1 |
| 8,074,410 | B1 * | 12/2011 | Ryba | 52/211 |
| 8,099,906 | B2 * | 1/2012 | Paul | 49/476.1 |
| 2003/0024184 | A1 * | 2/2003 | Orr et al. | 52/211 |
| 2004/0006938 | A1 * | 1/2004 | Schiffmann et al. | 52/211 |
| 2005/0028462 | A1 * | 2/2005 | Clarady et al. | 52/211 |
| 2007/0209300 | A1 * | 9/2007 | Rhode et al. | 52/204.1 |

* cited by examiner

*Primary Examiner* — Christine T Cajilig
(74) *Attorney, Agent, or Firm* — Altis & Wispro Law Group, Inc.

(57) ABSTRACT

A water resistant apparatus includes a chassis, a door, a sealing member, and a water guiding member. The door is mounted to the chassis, and a gap is defined between the chassis and the door. The sealing member includes a mounting portion and a blocking portion. The water guiding member is secured to the chassis and defines a guiding slot communicating with the gap. The mounting portion is secured to the water guiding member. The blocking portion is located between the door and the water guiding member and abuts the door. A water path is defined by the gap and the guiding slot.

20 Claims, 5 Drawing Sheets

WATER RESISTANT APPARATUS

BACKGROUND

1. Technical Field

The present disclosure relates to water resistant apparatuses, and particularly to a water resistant apparatus in a data center container.

2. Description of Related Art

Gaps are defined between a door and a chassis of a data center container. Water may flow into the chassis through the gaps to damage objects in the data center container.

Therefore, there is room for improvement in the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
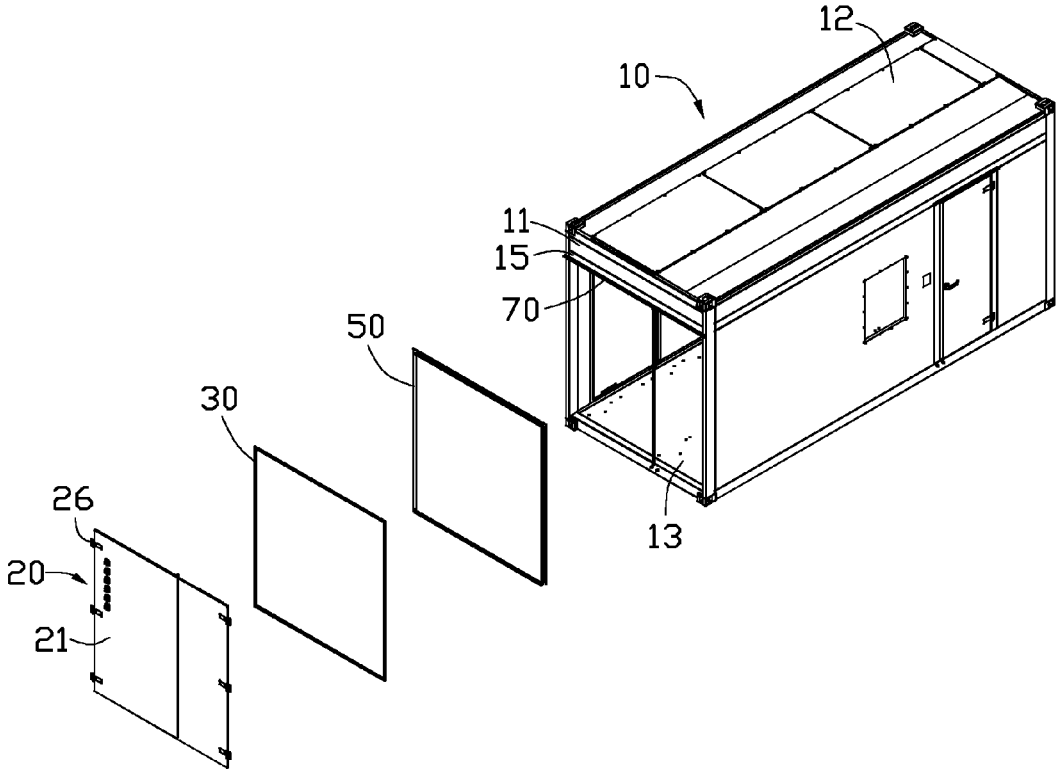
FIG. 1 is an exploded, isometric view of an embodiment of a water resistant apparatus.

FIG. 1 shows a water resistant apparatus in accordance with an embodiment. The water resistant apparatus comprises a chassis 10, a door 20, a sealing member 30, and a water guiding member 50.

The chassis 10 comprises a front plate 11, a top plate 12, and a bottom plate 13. In one embodiment, the top plate 12 is substantially parallel to the bottom plate 13 and is substantially perpendicular to the front plate 11. Abeam 15 is secured to the front plate 11. The door 20 is secured between the beam 15 and the bottom plate 13. The beam 15 comprises a front wall 151 and a bottom wall 153 (shown in FIG. 5). In one embodiment, the front wall 151 is substantially perpendicular to the bottom wall 153, and the bottom wall 153 is substantially parallel to the bottom plate 13.

Figure 5:
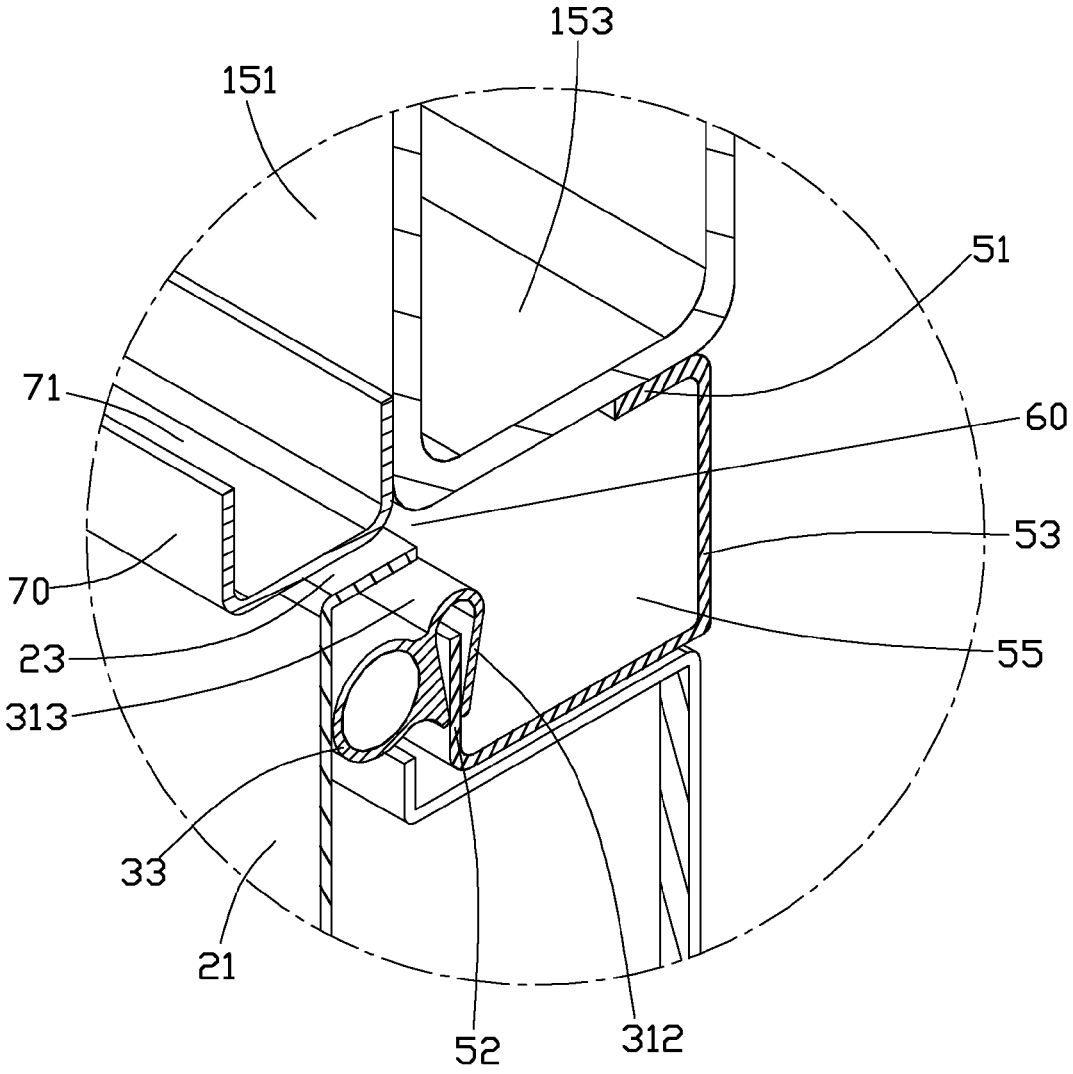
FIG. 5 is an enlarged view of a circled portion VI of FIG. 4.

The door 20 comprises a body 21 and a flange 23 extending from a top edge of the body 21 (shown in FIG. 5). The flange 23 is substantially perpendicular to the body 21.

FIG. 1 shows that the sealing member 30 comprises a mounting portion 31 and a blocking portion 33 connected to the mounting portion 31. The mounting portion 31 defines a latching slot 311 and comprises a mounting piece 312 and a latching piece 313. Both the mounting piece 312 and the latching piece 313 are elastically deformable. The latching piece 313 connects the mounting piece 312 to the blocking portion 33. In one embodiment, the latching piece 313 is arched. The blocking portion 33 is elastically deformable and defines a though hole 331. In one embodiment, the blocking portion 33 is circular, and the sealing member 30 is a rectangular frame.

FIG. 1 shows that the water guiding member 50 comprises an installation plate 51, a positioning plate 52, and a connecting portion 53 that connects the installation plate 51 to the positioning plate 52. In one embodiment, the installation plate 51 is substantially perpendicular to the positioning plate 52, and the connecting portion 53 is substantially "L" shaped. A guiding slot 55 is defined between the positioning plate 52 and the connecting portion 53. In one embodiment, the water guiding member 50 is a rectangular frame.

Figure 2:
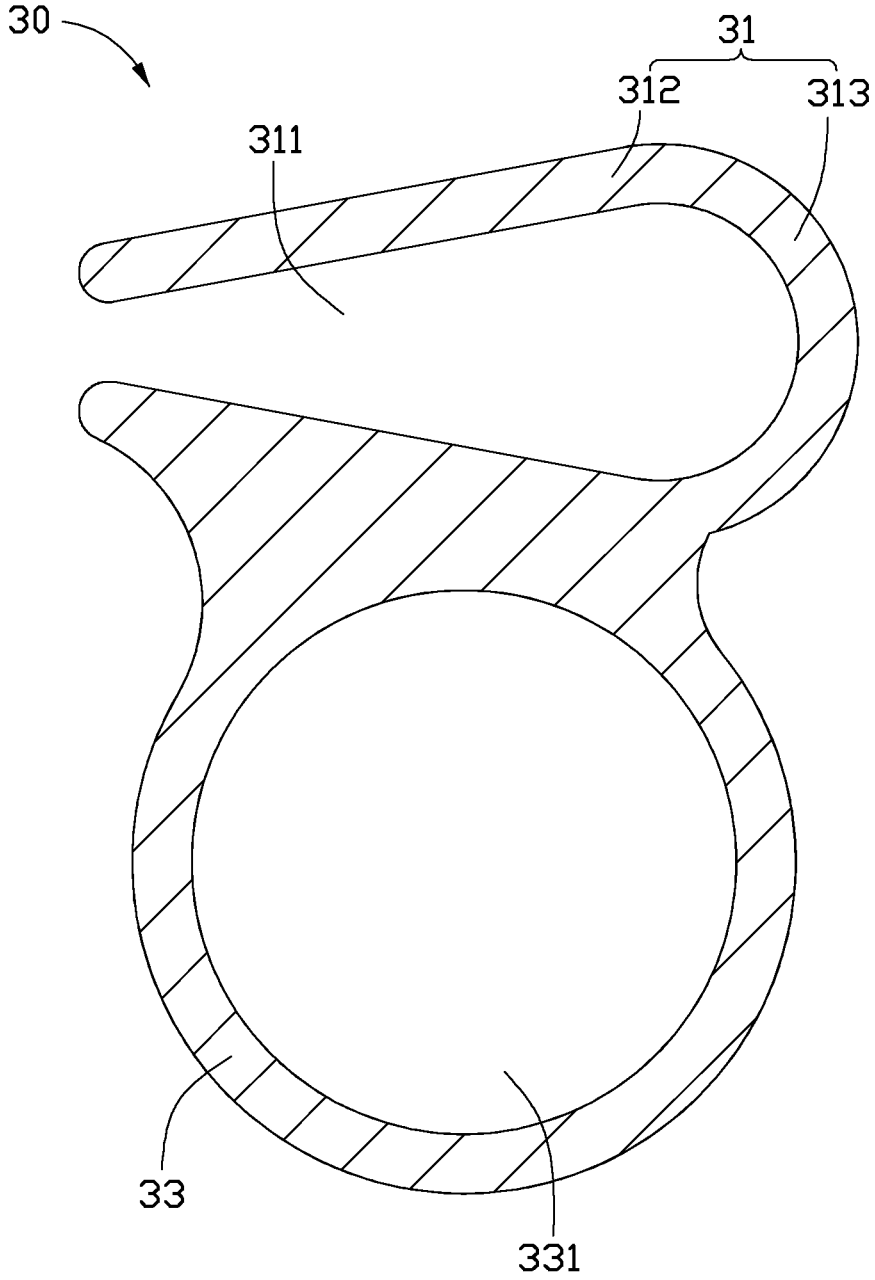
FIG. 2 is a cross-sectional view of a sealing member of FIG. 1.
Figure 3:
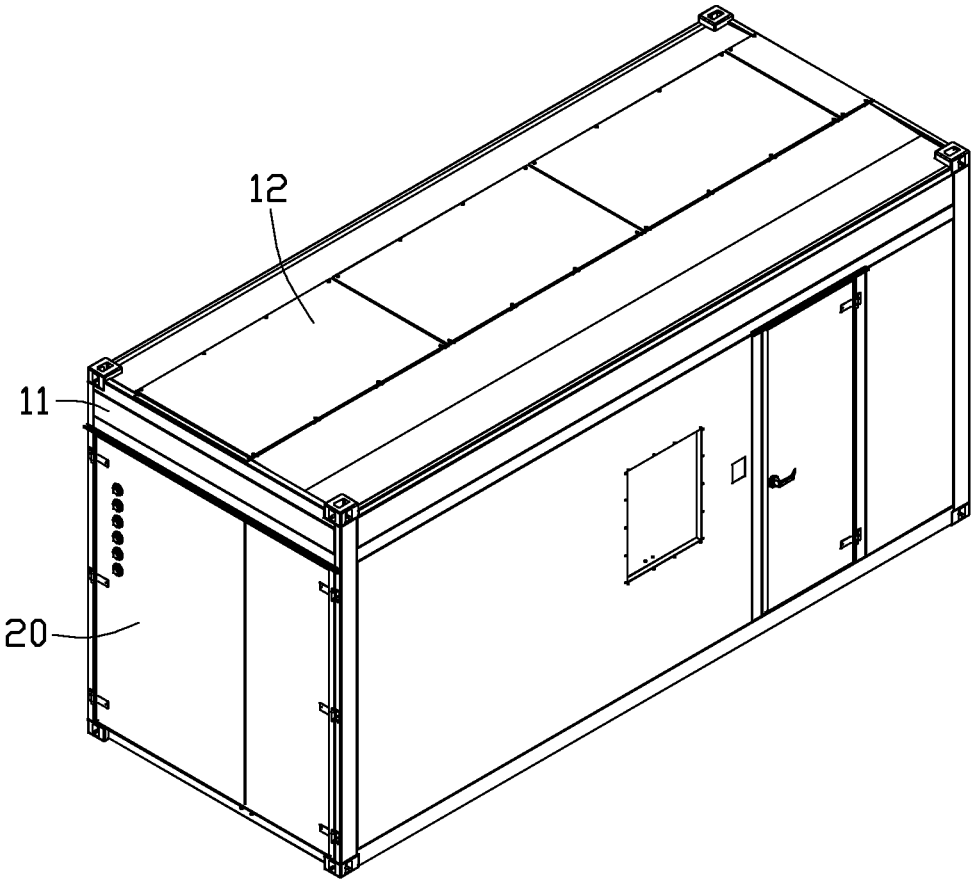
FIG. 3 is an assembled, isometric view of the water resistant apparatus of FIG. 1.
Figure 4:
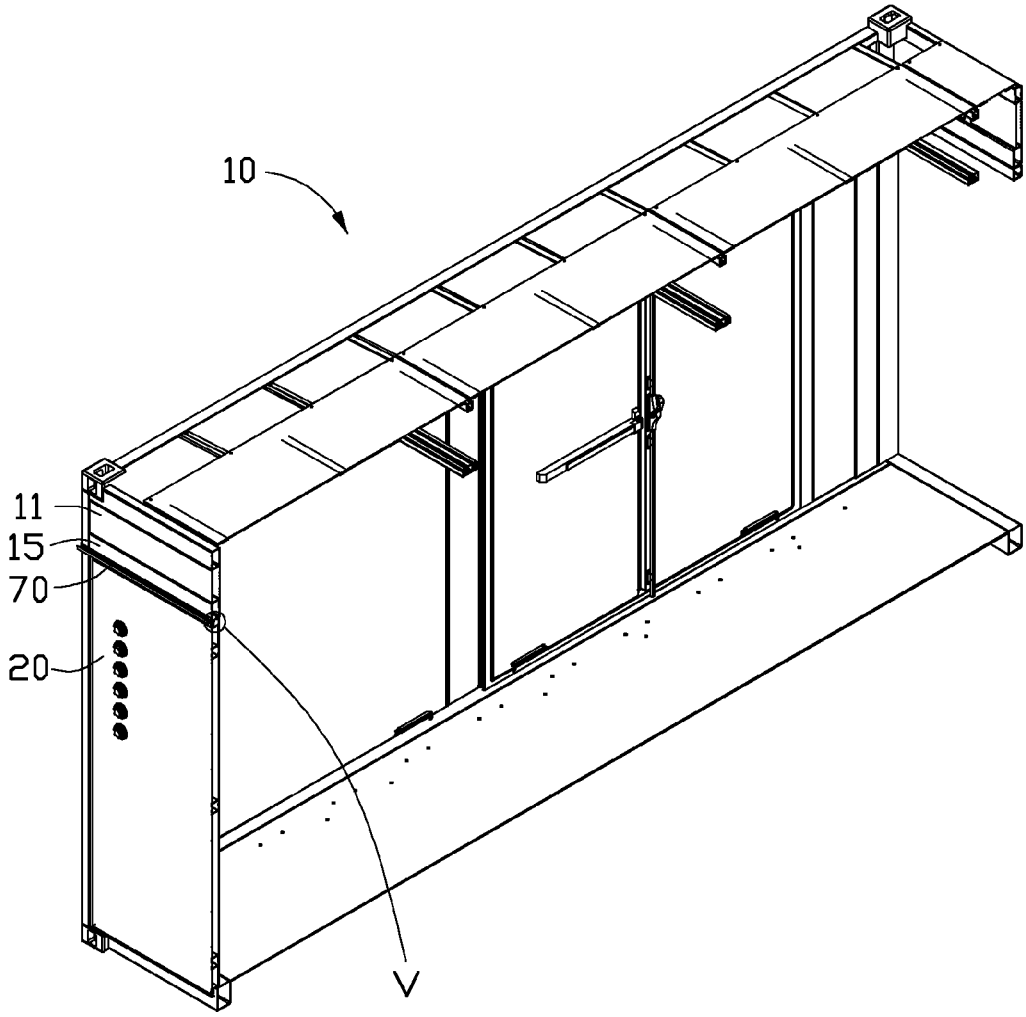
FIG. 4 is an isometric view of partially assembled water resistant apparatus of FIG. 1.

FIGS. 1-3 show that in assembly, the installation plate 51 is secured to the bottom wall 153 and is substantially parallel to the bottom wall 153. The sealing member 30 is moved to be adjacent to the water guiding member 50. The mounting piece 312 is elastically deformed outwards, and then the positioning plate 52 is inserted into the latching slot 311. The mounting piece 312 rebounds to sandwich the positioning plate 52 in the latching slot 311. Thus, the sealing member 30 is secured to the water guiding member 50. The door 20 is rotatably mounted to the chassis 10.

In use, the door 20 is rotated towards the front plate 11 until the door 20 abuts the sealing member 30. The door 20 is further rotated to elastically deform the blocking portion 33 and the latching piece 313. The sealing member 30 exerts elastic force to secure the door 20 between the beam 15 and the bottom plate 13. The latching piece 313 abuts a bottom surface of the flange 23. The blocking portion 33 abuts an inner surface of the body 21. Thus, the sealing member 30 seals gaps between the door 20 and the positioning plate 52. The blocking portion 33 is located between the body 21 and the positioning plate 52. The mounting portion 31 is located between the flange 23 and the connecting portion 53. A gap 60 is defined between the door 20 and the beam 15. The gap 60 communicates with the guiding slot 55. When water passes the water resistant apparatus, the water flows into the guiding slot 55 directly, and the guiding slot 55 guides the water to flow out of the chassis 10. Thus, the water is prevented from flowing into the chassis 10.

In another embodiment, the water resistant apparatus further comprises a second guiding member 70 secured to the beam 15. The second guiding member 70 defines a second guiding slot 71. When the water passes the chassis, a part of water is guided by the second guiding slot 71 to flow out of the chassis 10, to prevent mass water from flowing between the door 20 and the sealing member 30 through the gap 60.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A water resistant apparatus comprising:

a chassis;

a door mounted to the chassis, and a gap defined between the chassis and the door;

a sealing member comprising a mounting portion and a blocking portion; and a water guiding member, secured to the chassis, defining a guiding slot communicating with the gap;

wherein the mounting portion is secured to the water guiding member, and the blocking portion is located between the door and the water guiding member and abuts the door; and a water path is defined by the gap and the guiding slot; the mounting portion comprises a mounting piece and a latching piece connecting the mounting piece to the blocking portion, and the latching piece is elastically deformable; the mounting portion defines a latching slot; the water guiding member comprises a positioning plate; and the mounting piece sandwiches the positioning plate in the latching slot.

2. The water resistant apparatus of claim 1, wherein the door comprises a body and a flange extending from the body, the blocking portion abuts the body, and the latching piece abuts the flange.

3. The water resistant apparatus of claim 2, wherein the chassis comprises a front plate, a top plate, a bottom plate, and a beam secured to the front plate; the top plate is substantially parallel to the bottom plate and is substantially perpendicular to the front plate; the door is rotatably mounted between the beam and the bottom plate; the beam comprises a front wall and a bottom wall, and the front wall is substantially perpendicular to the bottom wall; the water guiding member further comprises an installation plate and a connecting portion connected to the installation plate and the positioning plate; the installation plate is secured to the bottom wall and is substantially parallel to the bottom wall; and the guiding slot is defined cooperatively by the installation plate, the positioning plate, and the connecting portion.

4. The water resistant apparatus of claim 3, wherein the installation plate is substantially perpendicular to the positioning plate, and the positioning plate is substantially parallel to the body.

5. The water resistant apparatus of claim 3, wherein the positioning plate is engaged in the latching slot, and the blocking portion is located between the body and the positioning plate.

6. The water resistant apparatus of claim 3, wherein the positioning plate is substantially perpendicular to the flange, and the mounting portion is located between the flange and the connecting portion.

7. The water resistant apparatus of claim 3, further comprising a second water guiding member, wherein the second water guiding member is secured to the front wall and defines a second guiding slot for guiding water out of the chassis.

8. The water resistant apparatus of claim 1, wherein the latching piece is arched.

9. The water resistant apparatus of claim 1, wherein a cross section of the blocking portion is circular, the mounting portion defines a through hole, and the through hole increases the elasticity of the mounting portion.

10. A water resistant apparatus comprising:

a chassis comprising a front plate, a top plate, a bottom plate opposite to the top plate, and a beam secured to the front plate;

a door mounted between the beam and the bottom plate and comprising a body and a flange extending perpendicularly from the body, and a gap defined between the flange and the beam;

a sealing member comprising a mounting portion and a blocking portion; and a water guiding member secured to the beam and defining a guiding slot communicating with the gap;

wherein the mounting portion is secured to the water guiding member and abuts the flange, and the blocking portion is located between the body and the water guiding member and abuts the body; and a water path is defined by the gap and the guiding slot.

11. The water resistant apparatus of claim 10, wherein the mounting portion comprises a mounting piece and a latching piece connecting the mounting piece to the blocking portion, and each of the mounting piece and the latching piece is elastically deformable; the mounting portion defines a latching slot; the water guiding member comprises a positioning plate; and the positioning plate is engaged in the latching slot.

12. The water resistant apparatus of claim 11, wherein the mounting piece is elastically deformable to engage the positioning plate in the latching slot.

13. The water resistant apparatus of claim 11, wherein the top plate is substantially parallel to the bottom plate and is substantially perpendicular to the front plate; the beam comprises a front wall and a bottom wall, and the front wall is substantially perpendicular to the bottom wall; the water guiding member further comprises an installation plate and a connecting portion connected to the installation plate and the positioning plate; the installation plate is secured to the bottom wall and substantially parallel to the bottom wall; and the guiding slot is defined cooperatively by the installation plate, the positioning plate, and the connecting portion.

14. The water resistant apparatus of claim 13, wherein the installation plate is substantially perpendicular to the positioning plate, and the positioning plate is substantially parallel to the body.

15. The water resistant apparatus of claim 13, wherein the blocking portion is located between the body and the positioning plate.

16. The water resistant apparatus of claim 13, wherein the mounting portion is located between the flange and the connecting portion.

17. The water resistant apparatus of claim 13, further comprising a second water guiding member, wherein the second water guiding member is secured to the front wall and defines a second guiding slot for guiding water out of the chassis.

18. The water resistant apparatus of claim 11, wherein the latching piece is arched.

19. The water resistant apparatus of claim 10, wherein a cross section of the blocking portion is circular, and the mounting portion defines a through, and the through hole increases the elasticity of the mounting portion.

20. A water resistant apparatus comprising:

a chassis comprising a front plate, a top plate, a bottom plate opposite to the top plate, and a beam secured to the front plate;

a door mounted between the beam and the bottom plate and comprising a body and a flange extending perpendicularly from the body, and a gap defined between the flange and the beam;

a sealing member comprising a mounting portion and a blocking portion;

a water guiding member secured to the beam and defining a guiding slot communicating with the gap; and a second water guiding member located above the flange, and the second water guiding member defines a second guiding slot for guiding water out of the chassis;

wherein the mounting portion is secured to the water guiding member and abuts the flange, and the blocking portion is located between the body and the water guiding member and abuts the body; and a water path is defined by the gap and the guiding slot.

* * * * *